US005329075A

United States Patent [19]

Hirabayashi et al.

[11] Patent Number: 5,329,075

[45] Date of Patent: Jul. 12, 1994

[54] ELEVATOR DOOR CONTROL APPARATUS

[75] Inventors: Terumi Hirabayashi; Masanori Tawada; Toshiyuki Kodera, all of Inazawa, Japan

[73] Assignee: Mitsubishi Denki Kabushiki Kaisha, Tokyo, Japan

[21] Appl. No.: 953,023

[22] Filed: Sep. 29, 1992

[30] Foreign Application Priority Data

Oct. 16, 1991 [JP] Japan ..... 3-267651

[51] Int. Cl.[5] ..... B66B 13/26

[52] U.S. Cl. ..... 187/104; 187/103; 318/284

[58] Field of Search ..... 187/103, 104; 318/284; 49/120, 117, 118

[56] References Cited

U.S. PATENT DOCUMENTS 4,300,663 11/1981 Hmelovsky et al. ..... 187/103
4,750,591 6/1988 Coste et al. ..... 187/130
5,137,118 8/1992 Iwata ..... 187/103

FOREIGN PATENT DOCUMENTS 2123088 10/1988 Japan .
0172293 7/1991 Japan ..... 187/103
8101836 7/1981 World Int. Prop. O. .

*Primary Examiner*—Steven L. Stephan
*Assistant Examiner*—Robert Nappi
*Attorney, Agent, or Firm*—Leydig, Voit & Mayer

[57] ABSTRACT

An elevator door control apparatus includes at least one door safety device for detecting whether elevator doors are safe; an elevator control circuit for outputting a door-open/close command; and a door control circuit for controlling the opening/closing of doors on the basis of a door-open/close command issued from the elevator control circuit and for outputting a door reversal request to the elevator control circuit on the basis of the operation signal of the door safety device, wherein the door control circuit outputs a door reversal request to the elevator control circuit upon reception of the operation signal of the door safety device while the doors are being closed on the basis of a door-close command from the elevator control circuit, switches the door speed command pattern to a brake pattern from the door-close command speed pattern and thereafter switches the door speed command pattern from the brake pattern to the door-open command speed pattern when the door-open command is received from the elevator control circuit instead of the door-close command.

4 Claims, 5 Drawing Sheets

ELEVATOR DOOR CONTROL APPARATUS

BACKGROUND OF THE INVENTION

1. Field of the Invention

The present invention relates to an elevator door control apparatus which is capable of quickly reversing the direction (opening/closing) in which elevator doors are moving when door-open buttons or door safety devices, such as safety switches, are operated, thereby increasing passenger safety.

2. Description of the Related Art

FIG. 4 is a block diagram illustrating a conventional elevator door control apparatus disclosed in, for example, Japanese Patent Laid-Open No. 2-123088. In FIG. 4, a microcomputer 2 (hereinafter referred to as a main computer) for controlling an elevator, disposed within a control panel 1, is connected to a door control circuit 4 through a control cable 3. The door control circuit 4 includes a microcomputer 5 (hereinafter referred to as a door computer) for controlling doors, a motor control circuit 6 and a motor drive circuit 7. A door motor 8 for opening/closing a pair of doors 14, a pulley 9 for a speed reducer, a rotor 10 and a belt 11 are disposed in the upper section of an elevator car 17. The pair of doors 14 are connected to the belt 11 via connection sections 12 and 13, respectively. A SHOE switch 15 and a door-open button 16 inside the car 17 are electrically connected to the main computer 2 and the door computer 5 through the control cable 3. The car 17 is moved upward and downward by a traction machine 19 through a rope 18 while being balanced by a counterweight 20.

Referring now to the timing chart of FIG. 5, the operation of the above-described apparatus of the prior art will be explained. The cycle of the timing at which signals are received by the main computer 2 is set at 40 ms, and the cycle of the timing at which signals are received by the door computer 5 is set at 10 ms.

It will now be assumed that the door motor 8 is being driven by the door computer 5 to close the doors 14 because the door computer 5 has received a command for closing the doors 14 from the main computer 2. Under this condition, if a signal for discontinuing the door-close operation is generated from the SHOE switch 15 or the door-open button 16 during the period of 10 ms from time T2 to T4, the door computer 5 can receive this signal at timing T3. In contrast, the main computer 2 cannot receive this signal because signal input timings T1 and T5 do not exist between times T2 and T4, during which period the stop signal is generated. Therefore, the state in which the door-close command signal is output to the doors by the main computer 2 does not change.

However, since, as described above, the door computer 5 can receive a signal for discontinuing the operation of closing the doors 14, the door computer 5, in response to this signal, immediately issues a command for stopping the operation of closing the doors 14 to the motor control circuit 6, causing the door motor 8 to be stopped by means of the motor drive circuit 7. As a result, the speed of the operation of closing the doors 14 is reduced during the period from time T3 to T4 and the doors 14 stop. The door computer 5 receives a command from the main computer 2 at timing T6 after the doors 14 are placed in a stopped condition for a predetermined time, and controls the opening/closing of the doors 14 in accordance with this command.

On the other hand, since the main computer 2 cannot receive signals from the door-open button 16 or the SHOE switch 15, and the state of the main computer 2 in which the door-close command is output is unchanged, the door computer 5 receives this command at timing T6 and immediately issues a command for closing the doors 14 to the motor control circuit 6 in order to control the driving of the door motor 8. As a result, the doors 14 are accelerated in a direction in which the doors 14 are closed from timing T6, and are thus closed.

If input timing of the main computer 2 exists in the period during which a signal for discontinuing the operation of closing the door 14 is generated, the doors 14 are discontinued by the same sequence as described above and then reversed to the direction which the doors 14 are opened.

In the conventional elevator door control apparatus described above, operation signals of a SHOE switch (a door safety device) or the like are received by both the main computer 2 and the door computer 5, the door computer 5 stops the operation of the doors 14 by itself while the computation by the main computer 2 is delayed. That is, the doors 14 are temporarily operated irrespective of the command of the main computer 2. For this reason, there is a problem described below.

For example, if, after the operation of a door fully-close switch for detecting the fully-closed condition of a door is confirmed, a brake of an elevator is released and the elevator is activated, the activation of the elevator is delayed by the operation time of the brake. For this reason, an elevator is provided which has a position switch for detecting that a door is positioned near a fully-closed position, the brake beginning to be released in accordance with the operation of the position switch, and the elevator being activated by the operation of the door fully-close switch. In this case, if a safety device, such as a SHOE switch, is operated or erroneously operated when the door which is being closed is positioned between the position switch and the door fully-close switch, and the door is stopped by the door computer 5, the door fully-close switch is not operated. Therefore, an extremely dangerous condition arises in which the brake is released by the operation of the position switch in spite of the fact that the elevator cannot be activated. Thus, there is a problem as regards safety.

In addition, there is another problem in that the number of control cables 3 corresponding to the number of safety devices is required to input operation signals of the safety device to both the main computer 2 and the door computer 5, thus increasing the cost of the apparatus.

SUMMARY OF THE INVENTION

The present invention has been achieved to solve the above-mentioned problems of the prior art.

An object of the present invention is to provide an elevator door control apparatus which is capable of quickly reversing the direction (opening/closing) in which the doors are moving while at the same time ensuring a high level of safety during the operation of safety devices.

The elevator door control apparatus in accordance with the present invention comprises at least one door safety device for detecting whether doors of an elevator are safe; an elevator control circuit for outputting a door-close command and a door-open command; and a door control circuit for controlling the opening/closing of doors on the basis of the door-open/close command issued from the elevator control circuit and for outputting a request for reversing the direction in which the doors are moving to the elevator control circuit on the basis of the operation signal of the door safety device.

DESCRIPTION OF THE PREFERRED EMBODIMENT

Figure 1:
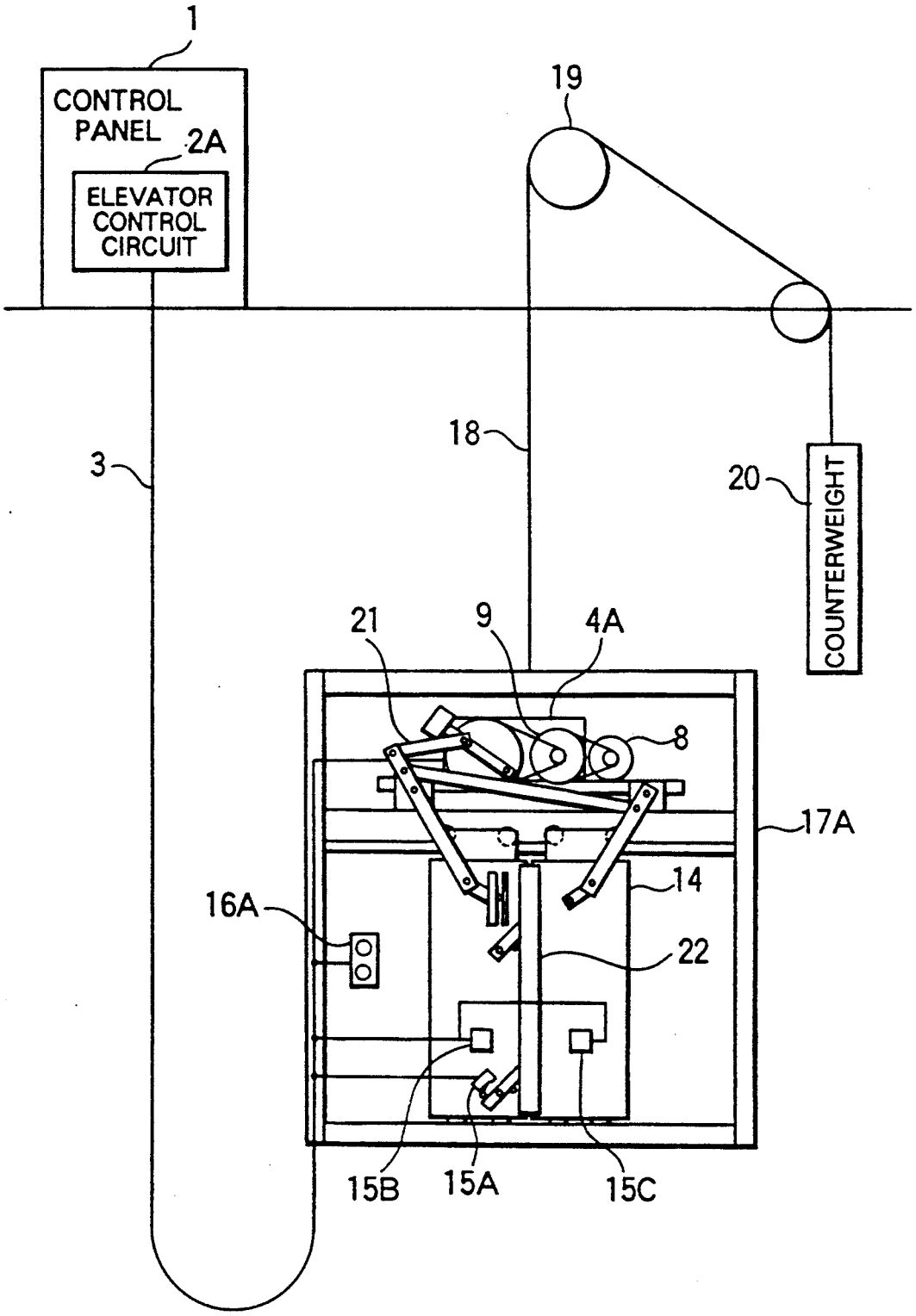
FIG. 1 is a block diagram illustrating an elevator door control apparatus of an embodiment of the present invention.

An embodiment of the present invention will be explained below with reference to the accompanying drawings. In FIG. 1, an elevator control circuit 2A is disposed within the control panel 1. A door control circuit 4A of an elevator car 17A is connected to the elevator control circuit 2A through the control cable 3. A pair of doors 14 are disposed in the car 17A. The driving force of the door motor 8 is transmitted to the doors 14 via the pulley 9 and a link 21, causing the doors 14 to be opened/closed. A door safety device 22, a safety switch 15A, and photoelectric door safety devices 15B and 15C are disposed in the doors 14. A car operation panel 16A having a door-open button switch and a door-close button switch mounted thereon, and an unillustrated ultra-sonic wave door safety device, are disposed inside the car 17A. The safety switch 15A, the photoelectric door safety devices 15B and 15C, the car operation panel 16A and an ultra-sonic wave door safety device are connected to the control cable 3. The car 17A is moved upward and downward by the traction machine 19 through the rope 18 while being balanced by the counterweight 20.

Figure 2:
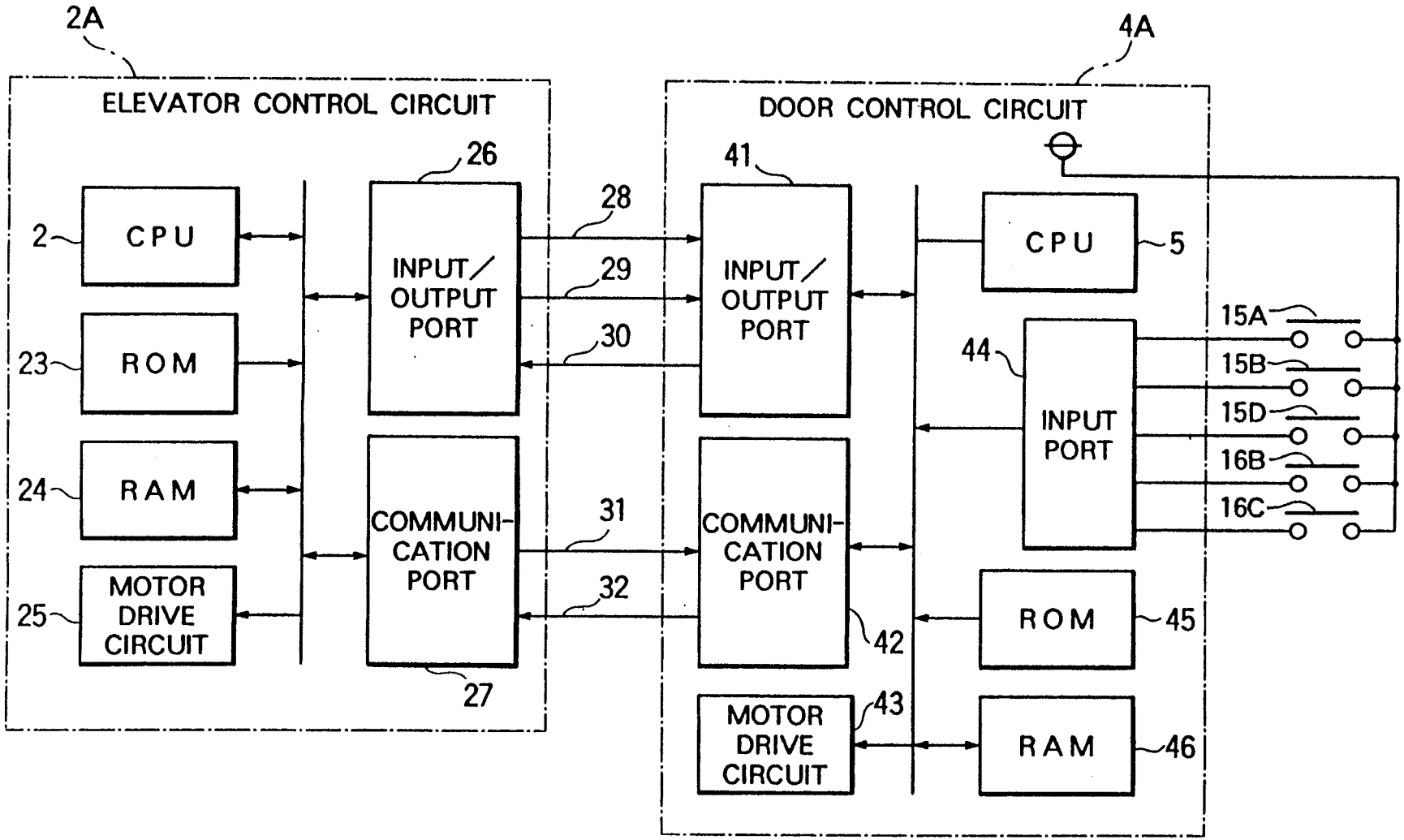
FIG. 2 is a block diagram illustrating the electric circuitry of an elevator control circuit and that of a door control circuit.

FIG. 2 shows the electric circuitry of the elevator control circuit 2A and the door control circuit 4A. In FIG. 2, the elevator control circuit 2A includes the main computer (CPU) 2, a ROM 23, a RAM 24, a motor drive circuit 25, an input/output port 26 and a communication port 27. The door control circuit 4A includes an input/output port 41, a communication port 42, a motor drive circuit 43, the door computer (CPU) 5, an input port 44, a ROM 45 and a RAM 46. Connected to the input port 44 are the safety switch 15A, the switch 15B of the photoelectric door safety device, the switch 15D of the ultra-sonic wave door safety device, a door-open button switch 16B and a door-close button switch 16C.

The input/output port 26 of the elevator control circuit 2A is connected to the input/output port 41 of the door control circuit 4A through a door-open command line 28, a door-close command line 29 and a door movement-reversal request command line 30. The communication port 27 of the elevator control circuit 2A is connected to the communication port 42 of the door control circuit 4A via a signal transmission line 31 and a signal receiving line 32.

A door-close command speed pattern, a door-open command speed pattern, and a rapid brake speed pattern corresponding to a movement-reversal command, for the doors 14, are prestored in the ROM 45 of the door control circuit 4A.

Figure 3:
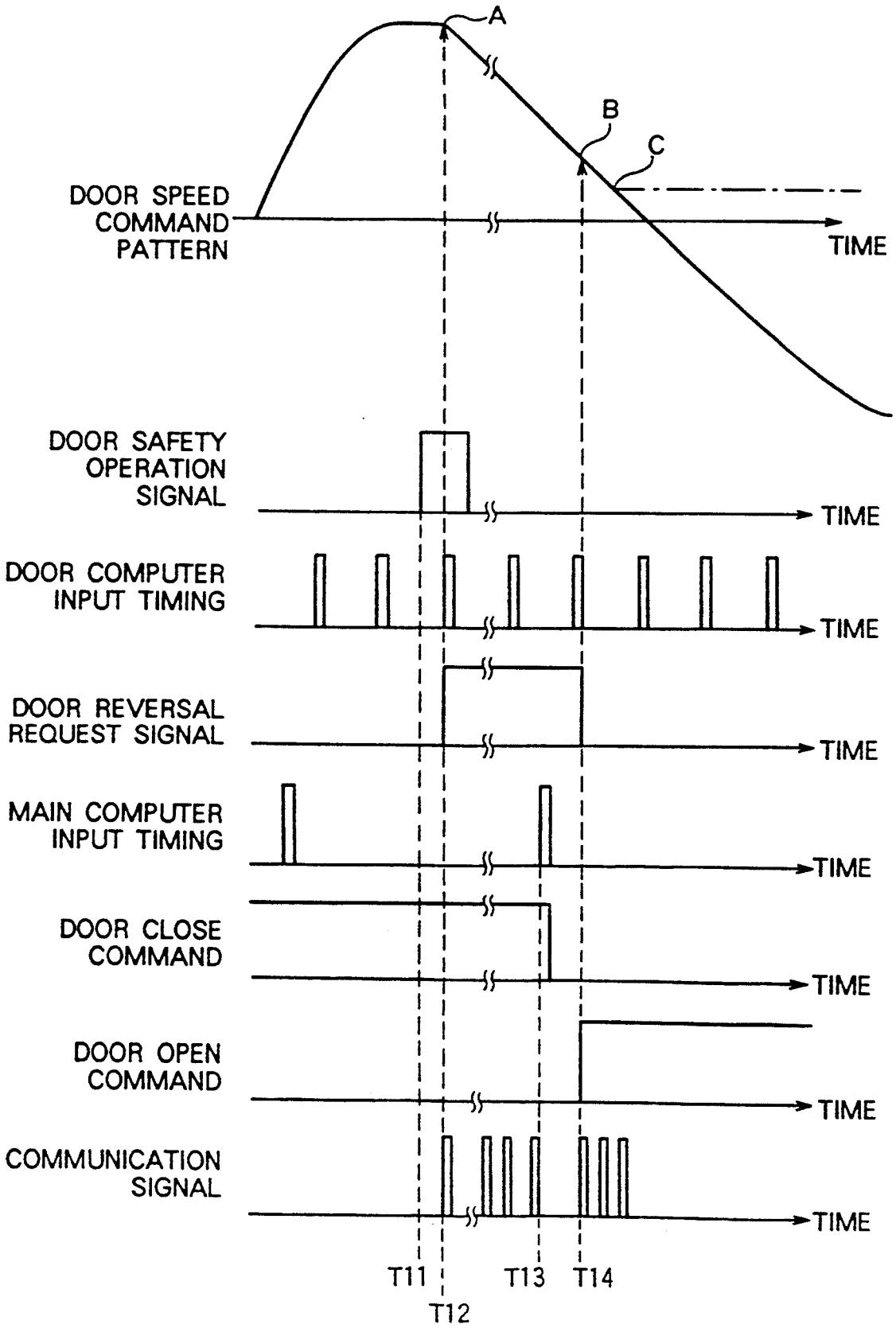
FIG. 3 is a timing chart illustrating the operation of the embodiment of the present invention.
Figure 4:
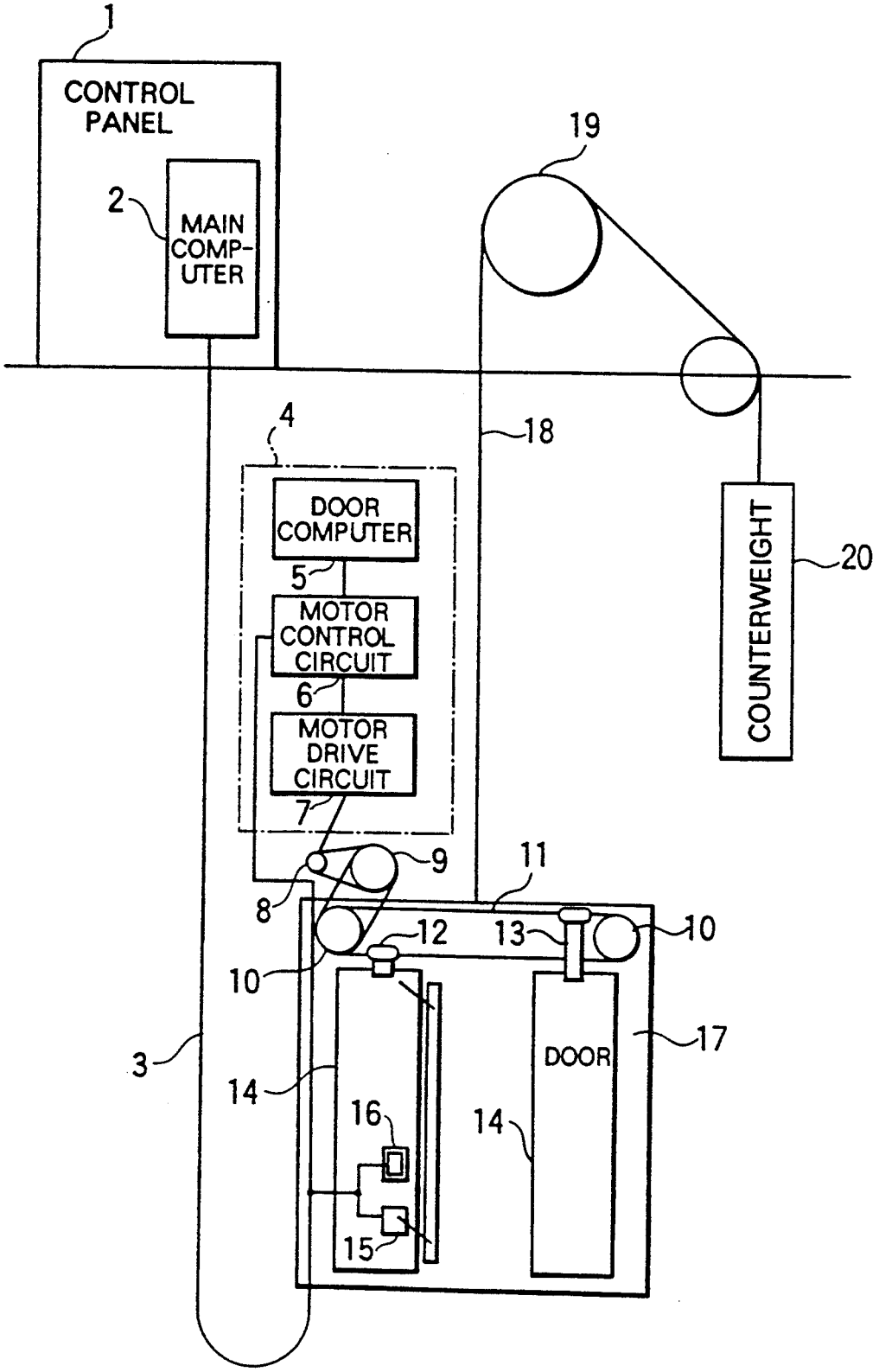
FIG. 4 PRIOR ART
FIG. 4 is a block diagram illustrating a conventional elevator door control apparatus.
Figure 5:
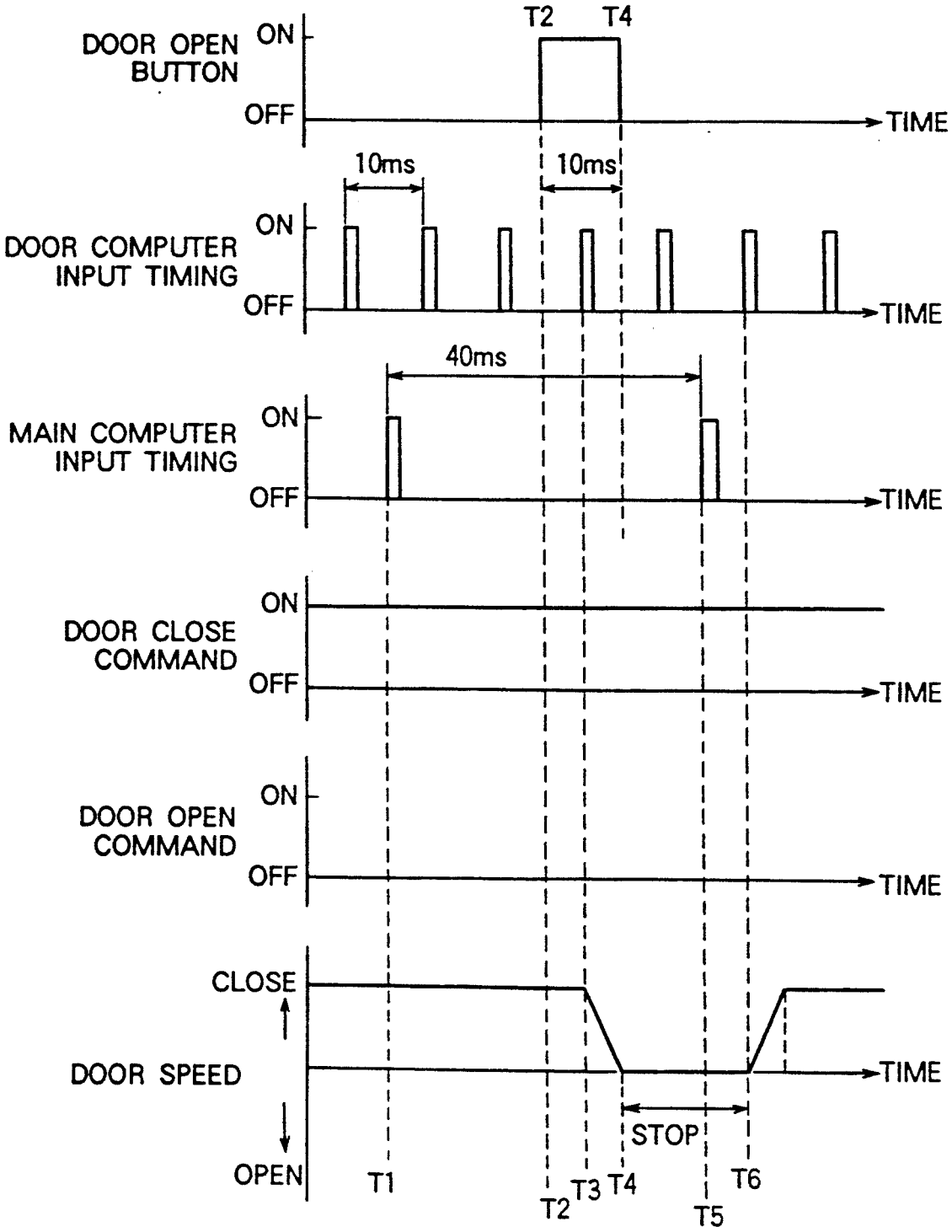
FIG. 5 PRIOR ART
FIG. 5 is a timing chart illustrating the operation of the apparatus shown in FIG. 4.

Next, the operation of this embodiment will be explained with reference to the flowchart shown in FIG. 3. The cycle of the timing at which signals are received by the main computer 2 is set at 100 ms, and the cycle of the timing at which signals are received by the door computer 5 is set at 10 ms.

First, when a door safety operation signal is generated from the safety switch 15A at time T11 while the doors 14 are being closed, the door computer 5 receives this signal at time T12 and outputs a door-reversal request signal to the elevator control circuit 2A from the input/output port 41 through the door-reversal request command line 30. The main computer 2 receives a door-reversal request signal at time T13, turns off the door-close command signal being outputted to the door control circuit 4A through the door-close command line 29, and then outputs at time T14 the door-open command signal to the door control circuit 4A through the door-open command line 28. The door speed command pattern is switched to a preset rapid brake speed pattern from the door-close command speed pattern at time A which is synchronous with time T12, and further shifts to the door-open command speed pattern at time B which is synchronous with time T14. When, however, no door-open command is generated at time T14, the rapid brake speed pattern arrives at time C without change, then shifts to a constant speed pattern as shown by a long and short dashed line, and the doors 14 are fully closed at the constant speed. Therefore, the doors 14 can be prevented from being stopped while they are being closed.

At time T11, the door computer 5 transmits, from the communication port 42 through the reception line 32 to the elevator control circuit 2A, serial coded communication signals indicating that the safety switch 15A has been operated. When, in addition to the safety switch 15A, the switch 15B of the photoelectric door safety device, the switch 15D of the ultra-sonic wave door safety device, and the door-open button switch 16B are operated, the same speed control of the doors as described above is performed. Communication signals indicating which of the respective safety devices have been operated are transmitted from the door control circuit 4A to the elevator control circuit 2A. As a result, it is possible for the main computer 2 to monitor the failure of safety devices by counting the number of times each safety device operates.

The door control circuit 4A, in addition to the above-described control, makes a judgment such that the output signals from each safety device are nullified when the doors 14 are being opened and positioned near a fully-opened or fully-closed position.

As has been explained above, according to this embodiment, output signals from all door safety devices are input to the door computer 5, and a door-reversal request signal is generated from the door computer 5 to the main computer 2. The door computer 5 controls the opening/closing of the doors 14 in accordance with the door-open/close command issued from the main computer 2. As a result, when the safety device is operated when the doors 14 are being closed, the doors 14 can be safely and quickly reversed from the direction in which the doors are moving. In addition, since output signals from all door safety devices are input only to the door computer 5 and need not to be input to the main computer 2, the number of cables required for signal transmission can be reduced.

The photoelectric door safety device and the ultrasonic wave door safety device used in the above-described embodiment are designed to detect whether there are obstacles in the doors by using a photoelectric sensor and a ultrasonic wave sensor, respectively. In addition to this, a safety device using an infrared-ray sensor or a pyroelectric sensor may be used.

What is claimed is:

1. An elevator door control apparatus comprising:

at least one door safety device for detecting whether elevator doors are safe;

an elevator control circuit for outputting a door-open/close command; and a door control circuit for controlling the opening/-closing of doors on the basis of a door-open/close command issued from the elevator control circuit and for outputting a door reversal request to the elevator control circuit upon reception of the operation signal of the door safety device while the doors are being closed on the basis of a door-close command speed pattern from the elevator control circuit, for switching the door speed command pattern to a brake pattern from the door-close command speed pattern, for thereafter switching the door speed command pattern from the brake pattern to the door-open command speed pattern when the door-open command is received from the elevator control circuit and for generating a constant speed door-close command speed pattern when a door-open command is not generated by said elevator control circuit within a predetermined time period beginning when the door speed command pattern is changed from the door-close command speed pattern to the brake pattern and ending when the doors reach a predetermined low speed.

2. An elevator door control apparatus according to claim 1, wherein the door safety device uses any one of a door safety switch, a photoelectric sensor, an ultrasonic wave sensor, an infrared ray sensor and a pyroelectric sensor.

3. An elevator door control apparatus according to claim 1, wherein the door control circuit outputs, to the elevator control circuit, a communication signal indicating which door safety device the operation signal is received from when the door reversal request is output to the elevator control circuit.

4. An elevator door control apparatus comprising:

at least one door safety device for generating an operation signal;

an elevator control circuit for outputting a door-open/close command; and means for controlling the opening/closing of doors on the basis of a door-open/close command issued from the elevator control circuit and for outputting a door reversal request to the elevator control circuit upon reception of the operation signal from said door safety device, said means for controlling the opening/closing of doors generating a constant speed door-close command speed pattern when a door open command is not generated by said elevator control circuit within a predetermined time and switching door-close command pattern to a brake pattern upon detection of the operation signal wherein the predetermined time is defined as the time period between which the door-close speed command pattern is switched to the brake pattern and the doors reach a predetermined low speed.

* * * * *